United States Patent [19]

Morrison

[11] 4,213,749

[45] Jul. 22, 1980

[54] PORTABLE VIBRATING CONCRETE SCREED

[76] Inventor: Donald R. Morrison, 2109 Camp Green St., Charlotte, N.C. 28208

[21] Appl. No.: 883,955

[22] Filed: Mar. 6, 1978

[51] Int. Cl.[2] ..... B28B 1/08

[52] U.S. Cl. ..... 425/456; 404/119; 404/120

[58] Field of Search ..... 404/119, 120; 425/456

[56] References Cited

U.S. PATENT DOCUMENTS

| | | | |
|---|---|---|---|
| 2,299,700 | 10/1942 | Millikin | 404/120 |
| 3,412,658 | 11/1968 | Griffin | 404/119 |
| 3,817,644 | 6/1974 | Matson | 404/120 |
| 4,030,873 | 6/1977 | Morrison | 404/119 |

*Primary Examiner*—John A. Parrish

*Attorney, Agent, or Firm*—B. B. Olive

[57] ABSTRACT

A lightweight and portable vibrating screed is made up of a base frame unit which mounts a variable speed drive engine and to which other pivotal sub-frame units may be attached for extending the length of the screed. A shaft is supported with a substantial amount of play between the shaft and its support bearings for rotation between a trailing pair of screed blades to which vibration is imparted throughout the length of the screed as the shaft is driven by the engine. The engine vibration is also imparted in a manner to cause the screed to creep forward which reduces the force required to advance the screed over the concrete. A third leading blade to which relatively minimal vibration is imparted acts to level the concrete, substantially reduces manual puddling and improves the screeding accomplished by the trailing pair of blades.

1 Claim, 6 Drawing Figures

PORTABLE VIBRATING CONCRETE SCREED

BACKGROUND OF THE INVENTION

1. Field of the Invention

This invention relates to lightweight, portable, vibrating, concrete screeds.

2. Description of the Prior Art

Concrete floor or slab construction normally involves the steps of pouring, compacting, puddling, screeding, and surface finishing. Leveling of a concrete surface by hand with the aid of a straight edge supported on form boards and applied in a horizontal sawing motion is known to produce an extremely flat, smooth surface. However, the concrete in this practice is typically manually puddled or roughly smoothed by hoe-like boards before being smoothed by the straight edge. Thus, substantial manual labor is involved. Machines have been gradually developed to accomplish many of the conventional manual screeding steps. vibrating beams or screeds which compact and screed the concrete at the same time are generally used on concrete floor slabs. In order to achieve the necessary compaction effect, the beams are equipped with vibrators driven by electric motors or gasoline engines. These heavy machines are difficult to use and move from one location to another and are costly to acquire and maintain.

Several types of relatively lightweight and less expensive, vibrating concrete screeds have been produced. These vibrating concrete screeds utilize different types of vibrating devices which are usually spaced along the length of the screed. However, the main force of vibration is not uniformly spread along the length of the screed because of being concentrated near the vibrating unit. Vibration imparted to the concrete by screeds of this type often have a tendency to be damped out completely or to be drastically reduced at the extremities of the screed supported on the concrete form. With the foregoing in mind, applicant has heretofore provided an improved, lightweight and portable concrete screed having two vibrated blades and which is fully described in applicant's prior U.S. Pat. No. 4,030,873. While providing significant improvement over the prior art screeding devices, the vibrating concrete screed described in U.S. Pat. No. 4,030,873 has also been found to be in need of improvement. In particular, substantial manual puddling has still been required even with the improved apparatus described in applicant's patent. Difficulty has been encountered in the screeding process when the rough concrete in front of the screed is very irregular, i.e., where there are mounds and valleys of concrete to be finished. It has also been found that the concrete will sometimes run under the leading vibrating blade when the screed is pulled forward through the concrete as the blades are vibrated. Also, it would be desirable to reduce the amount of force required to advance the screed forwardly so as to reduce the force needed for winching or manual pulling of the screed.

It, thus, becomes the general purpose of the present invention to improve upon the vibrating concrete screed described in applicant's U.S. Pat. No. 4,030,873.

SUMMARY OF THE INVENTION

In accordance with the present invention, there is provided a portable, lightweight, vibrating concrete screed having an elongated, open frame structure of triangular cross section and which mounts three screed blades. The trailing pair of screed blades are primarily employed for vibrating, compacting and finish smoothing the concrete whereas the leading blade to which minimal vibration is imparted provides means for scraping or puddling the concrete prior to the concrete reaching the trailing pair of blades. The screed includes a base frame unit on which the drive engine is mounted and may also be made up of other individual subframe units of varying or equal length interconnected to the base frame unit. A turnbuckle arrangement is provided between interconnected frame units for easily and quickly adjusting the individual frame units so that the surface of the concrete between forms may be finished in various configurations, such as flat, crowned, or with a valley.

The open structure frame mounts the three spaced apart screed blades, all of which are adapted to engage and level the concrete as the screed is moved forwardly over the surface and the trailing pair of blades are also adapted to vibrate and compact the concrete. Bearing mounts are fixed on the frames centrally between the trailing blades and are spaced inwardly from each end of the frame and loosely receive sealed roller bearings. A shaft is loosely supported for rotation with considerable play between the bearings and the shaft and extends throughout the length of the frame and beyond the outermost bearing mounts. In cross section, the apex of the frame is located above the center blade. A variable speed drive source, e.g., a gasoline-driven engine, is mounted on the frame for rotating the shaft at a sufficient speed to cause deflection or play of the shaft between and beyond the bearings and to impart uniform vibrations throughout the length of each of the trailing screed blades while imparting minimal vibration to the leading screed blade. The engine is mounted above and substantially centrally between the trailing screed blades and when in operation imparts a force to the screed which causes it to creep forwardly which reduces the amount of force required to manually pull or winch the screed forwardly over the concrete being screeded. Variable speed control is achieved by use of the engine throttle so as to vary the amount of vibration applied to the trailing pair of screed blades.

The present invention also offers a winch system which can be operated by an operator so as to avoid manual pulling. The winch system provides means for gradually pulling both ends of the screed simultaneously and at the same rate or, preferably, for moving each end of the screed independently enabling the screed to be moved at different speeds and angles from time to time to improve the efficiency of both puddling and screeding operations effected by the screed.

DESCRIPTION OF THE PREFERRED EMBODIMENT

Figure 1:
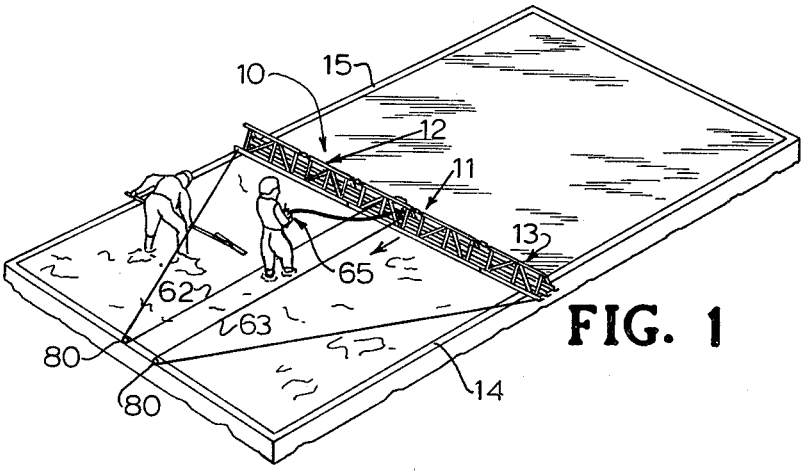
FIG. 1 is an isometric view of the present portable, adjustable, three-blade, vibrating concrete screed utilizing a base frame unit and a pair of sub-frame units.

As best illustrated in FIG. 1, screed 10 is illustrated as being formed of three individual frame units indicated by numerals 11, 12, 13 connected together to form a sufficient length to extend between and be supported by opposed form walls 14, 15. Frame units 11, 12, 13 can be of various lengths and can be easily and quickly connected together in a manner to be described so as to provide different lengths of screeds for spanning forms of different widths.

Base frame unit 11 and extension sub-frame unit 12 could each, for example, be ten feet in length and are assumed to be illustrated as such. Shorter extension sub-frame units may be used and could, for example, be five feet in length with extension sub-frame unit 13 being assumed to be of such length. Even shorter units of two and one-half feet are most useful. Screed 10 of the present invention is illustrated as a twenty-five foot screed but is capable of spans of seventy-five feet to one hundred feet to be worked and screed 10 can be maneuvered over or around pipes, anchor bolts, conduits, and the like.

Screed 10 utilizes an elongated, open base frame unit 11 having an isosceles triangle cross section. Three laterally spaced screed blades 16, 17, 18 are illustrated as right angular members having vertical and horizontal legs which in the embodiment being described are, for example, two inches in width, designated W although other size angles can be used. The illustrated frame and blades are preferably formed of aluminum to reduce weight but may otherwise be formed of any suitable material. Screed blades 16, 17, 18 extend throughout the length of base frame unit 11 and are adapted to engage, smooth, compact and finish the concrete as screed 10 is moved with a vibrating action applied primarily through blades 17, 18 over the freshly-poured, rough concrete in the direction of the arrows indicated in FIGS. 1 and 3. In this operation, leading screed blade 16 has relatively little vibration imparted to it and thus primarily acts to puddle or roughly smooth and roughly level the concrete prior to the vibratory action applied by the trailing blades 17, 18 between which shaft 32 vibrates, as later explained.

Figure 3:
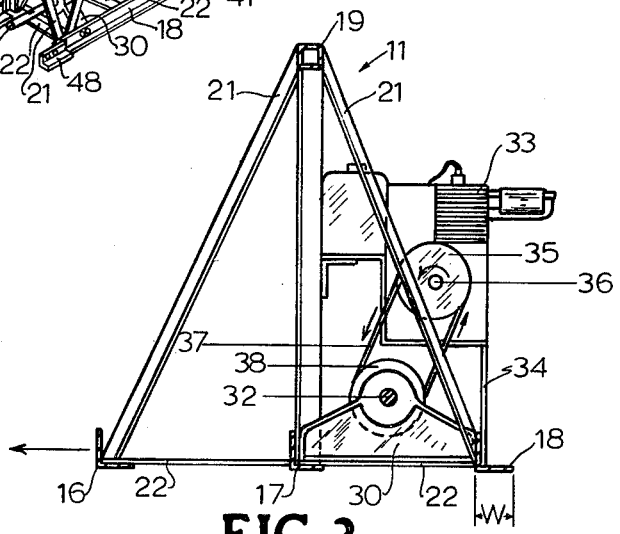
FIG. 3 is a section view, at an enlarged scale and looking inwardly in the direction of line 3—3 of the base frame unit shown in FIG. 2.

The open structure base frame unit 11 is preferably formed as an isosceles triangle, in cross section, with screed blades 16 and 18, as seen in cross section in FIG. 3, forming the lower corners of the triangle and with a square aluminum tubing member 19 forming the upper corner or apex of the triangle. Screed blade 17 is positioned midway between blades 16 and 18 and the bottom smoothing surfaces of screed blades 16, 17, 18 are aligned so as to reside in the same plane when in contact with the concrete. Tubing member 19 extends throughout the length of frame unit 11 and is connected or made integral with screed blades 16, 17, 18 by welding, bolting, molding, et cetera, with suitable cross braces 20. Also, vertical connector members 21 are fixed at their lower ends to screed blades 16, 17, 18 and at their upper ends to tubing member 19. Horizontal brace or connector members 22 extend from leading screed blade 16 to screed blade 17 and from screed blade 18 to screed blade 17.

With the described screed blade and frame arrangement wherein the apex of the frame is located above the blade 17 and later-described vibrating shaft 32 is mounted above and between the trailing screed blades 17, 18, the vibration effect is imparted primarily to the trailing blades 17, 18. Leading blade 16 is maintained substantially free of vibration and is therefore ideally suited for rough puddling or smoothing which greatly reduces the manual puddling labor that precedes screeding and this arrangement also makes far more effective the smoothing and compacting action imparted to the concrete by the vibrated blades 17, 18. Furthermore, substantially less concrete now tends to flow under leading blade 16 than was the case with the apparatus described in applicant's prior U.S. Pat. No. 4.030,873.

Figure 2:
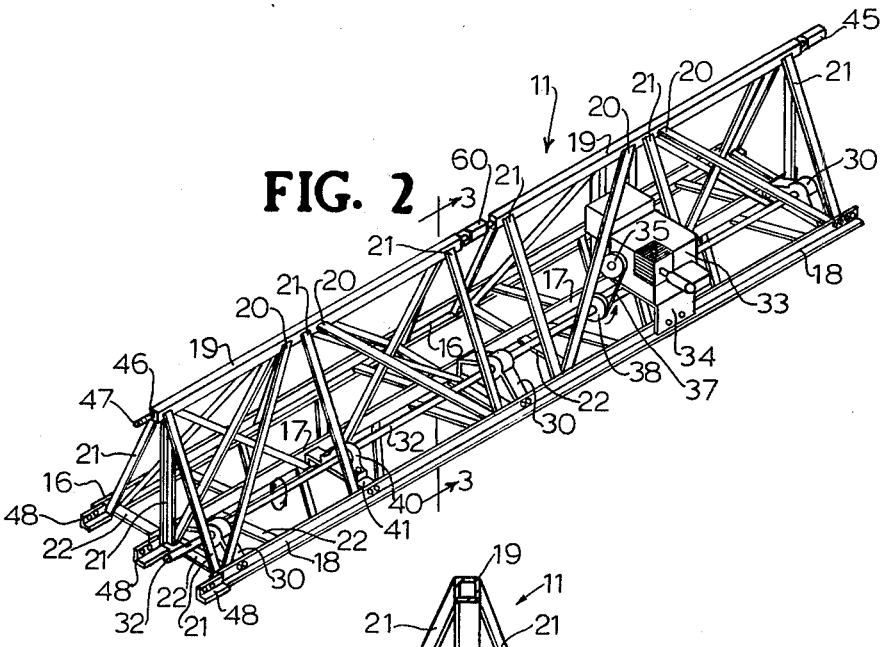
FIG. 2 is an enlarged isometric view of the base frame unit of the screed of the present invention with the drive means for rotating the vibrating shaft mounted thereon and with the winching apparatus removed for purposes of illustration.

Base frame unit 11 has bearing support castings 30 which transversely bridge the distance between screed blade 17 and screed blade 18. Castings 30 are made integral with plates 17 and 18 by bolting, welding, or the like and each casting receives a suitable, sealed roller bearing 31 loosely mounted therein. Bearing support castings 30 are so placed in base frame unit 11 that there are, in the preferred embodiment, four such castings in base frame unit 11. Bearings 31 mount shaft 32 for rotation therein. It is preferred that shaft 32 be three-quarters inch in diameter and that the shaft openings in bearings 31 be slightly larger so as to provide a loose fit and thereby permit vibration and play of shaft 32 as it is rotated. Bearings 31 are, in the preferred embodiment, mounted with thirty to sixty thousandths of an inch play within casting 30 and there is also thirty thousandths of an inch play between shaft 32 and bearing 31. As best illustrated in FIG. 2, shaft 32 extends throughout the length of base frame unit 11 and beyond the outermost bearing support castings 30 by a distance of approximately ten inches. In addition to castings 30 and bearings 31, a pillar block bearing 40 is mounted on base frame unit 11 by bolting bearing 40 to bearing support 41 which is bolted to blades 17, 18 and transversely bridges the distance between blades 17 and 18. Bearing 40 receives shaft 32 in a snug rotating relation. Bearing 40 helps maintain shaft 32 in a fixed position in base frame unit 11 while shaft 32 is allowed to vibrate within bearings 31 of castings 30.

A variable speed drive source, illustrated as a gasoline-driven engine 33, is mounted on base frame unit 11 by means of engine mount 34 integrally secured by welding to base frame unit 11 and to which engine 33 is bolted. A drive pulley 35 is fixed on the output shaft 36 of engine 33 and drives a V-belt 37 which in turn drives a larger pulley drive 38 fixed on vibrating shaft 32. Speed control is provided on engine 33 through throttle control thereof for varying its speed and thereby enabling the operator to vary the amount of vibration imparted to shaft 32. As illustrated, shaft 32 is positioned above and midway between screed blade 17 and screed blade 18. Engine 33 is so situated on engine mount 34 that the engine weight is distributed substantially evenly between screed blade 17 and screed blade 18 and with substantially none of the engine weight being applied to leading blade 16. Engine 33 drives pulleys 35, 38 and V-belt 37 in the direction shown. The force generated by engine 33 tends to cause screed 10 to creep in the forward direction. This movement in itself with a short width screed provides substantially forward motion to the screed and substantially reduces the force required to pull the screed over the concrete. A definite advantage and improvement over the screed illustrated in U.S. Pat. No. 4,030,873 is achieved. All other known prior art screeds tend to vibrate up and down with no forward motion. Leading screed blade 16 tends to level the rough concrete off smooth and this puddling-type operation is followed by screed blade 17 and screed blade 18 applying a greater weight upon the bottom surfaces of blades 17, 18 which achieves a much smoother surface than has been possible with the earlier type screed shown in the patent. Considerably less manual puddling and post-screeding finish work is required.

Figure 4:
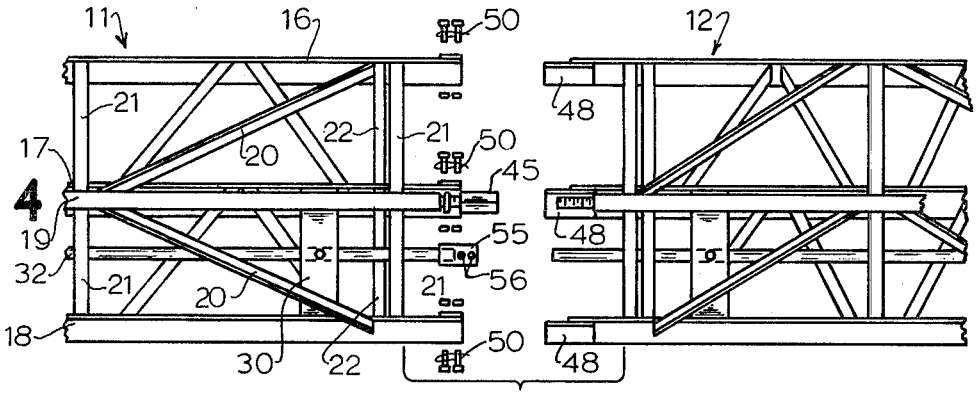
FIG. 4 is a fragmentary plan view of the right-hand end of the base frame unit shown in FIG. 2 and illustrating the mating end of a sub-frame unit in position to be assembled therewith.

As previously mentioned, sub-frame units 12, 13 are connected to base frame unit 11 to achieve whatever screed length is needed. Such connection is achieved by an adjustable turnbuckle 45. For purposes of mounting turnbuckle 45, the square aluminum tubing 19 has an end plate 46 at each end thereof and which closes the ends of tubing 19. Each end plate 46, in turn, has a threaded shaft 47 integrally mounted therein and extending outward therefrom in a plane parallel to tubing 19. Threaded shaft 47 receives in an adjustable manner turnbuckle 45. Turnbuckle 45 is screwed onto shaft 47 at one end and is capable of receiving a second shaft 47 on the opposite end so that by rotation of turnbuckle 45, base frame unit 11 and the sub-frame unit are drawn together or forced apart as the case may be. Blades 16, 17 and 18 are also provided with means for connecting similar blades of an adjacent sub-frame unit thereto. Angle extensions 48 are rigidly secured to a selected end of blades 16, 17, and 18 and extend outwardly therefrom. Bolts 50 connect the adjoining frame units. FIG. 4 more clearly illustrates, in an exploded view, such a connection between base frame unit 11 and sub-frame unit 12.

A coupling sleeve 55 is provided for one end of shaft 32 of base frame unit 11 for use in connecting an additional frame shaft thereto. Coupling sleeve 55 is rigidly secured by welding, et cetera, to the end of shaft 32 of base frame unit 11. Lock screws 56 connect coupling sleeve 55 to a mating shaft of sub-frame unit 12. The illustrated long extension sub-frame unit 12 is identical in construction to that of base frame unit 11 except that unit 12 does not have an engine or engine mount as with base frame unit 11 and there are five bearing support castings 30 with no pillar block bearing. Connection of unit 12 to unit 11 is accomplished by (1) threading turnbuckle 45 onto a mating threaded shaft of frame unit 12 which is made integral with the tubing of sub-frame unit 12, (2) connecting coupling sleeve 55 to the mating shaft of unit 12 and tightening lock screws 56 thereon, and (3) connecting angle extensions 48 of blades 16, 17, and 18 to mating blades of unit 12 with connecting bolts 50. Once completely connected, rotation of shaft 32 by drive engine 33 in turn drives the mating shaft of unit 12 in the same vibratory fashion to impart uniform vibration to both blades 17 and 18 throughout the screed length.

Short extension sub-frame unit 13 is likewise connected to base frame unit 11 through turnbuckles 45, coupling sleeve 55 and angle extensions 48. The rotation of shaft 32 by drive engine 33 in turn drives the mating shaft of unit 13 in the same vibratory fashion. While not illustrated, even shorter frame units in the order of two and one-half feet are found to be extremely useful and are connected in the same manner. Screed spans up to one hundred feet are possible by adding of frame units to base frame unit 11. Spans may be varied in length by the simple addition or removal of two and one-half, five and ten foot units. It has been found that with a longer length of screed, more vibration is achieved.

In addition to providing connecting means, turnbuckle 45 also provides for camber adjustments to provide the capability to obtain a flat slab as well as the ability to form crowns or valleys. In order to adapt screed 10 for formation of crowns or valleys, turnbuckle 45 is contracted or expanded dependent upon which arrangement is desired, i.e., valley or crown.

Figure 5:
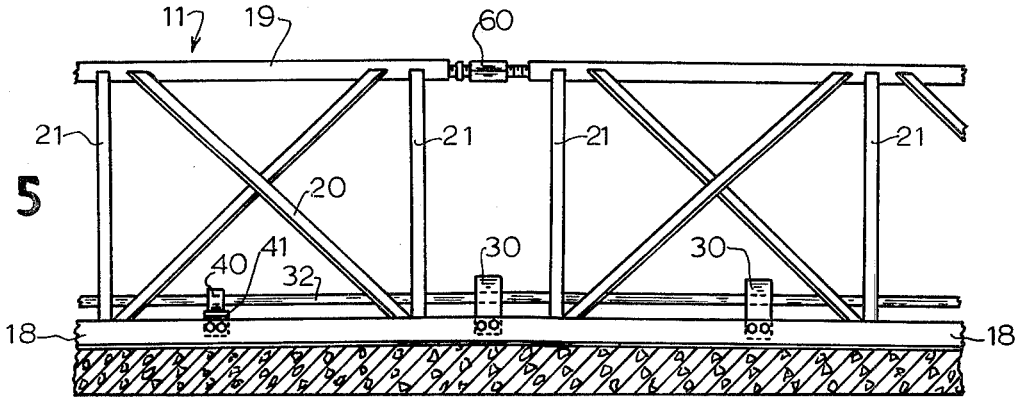
FIG. 5 is a fragmentary side elevation view of the base unit of FIG. 2 but showing the base frame unit adjusted to form a crown in the surface of the concrete.

FIG. 5 is illustrative of a base frame unit 11 and illustrating turnbuckle 60 located midway the length thereof for adjusting base frame unit 11 to form a crown in the surface of the concrete being worked. By locating a turnbuckle 60 midway base frame unit 11, the base frame unit can be used by itself to smooth and work narrow width areas in the ten foot or less range and by adjusting turnbuckle 60 a crown or valley can be placed in the surface of the concrete. As turnbuckle 60 is expanded or retracted, blades 16, 17 and 18 are flexed upwardly or downwardly dependent upon the direction of turn of turnbuckle 60. Flexing blades 16, 17 and 18 is possible without actually placing a crease or bend in the blades. Adjustments in the range of zero degrees to five degrees are possible. By connecting sub-frame units to base frame unit 11 and by adjusting turnbuckles 45 and 60 and when spread out over a long span, several inches of rise or fall on the surface of the concrete is possible. It is also possible to start out with a flat slab and by adjusting turnbuckles 45 and 60, while screed 10 is being operated, develop a crown or valley further along the concrete in the same operation. While the improved turnbuckle arrangement illustrated here had been previously employed with the two blade screed illustrated in U.S. Pat. No. 4,030,873, it had not, prior to the present invention, been employed with a three blade screed. More specifically, mounting of the turnbuckle at the apex of the triangular cross-section shaped frame enables the described flat, crown and valley operations to be achieved, the bottom operating surfaces of blades 16, 17 and 18 to be maintained in the same plane and the puddling effect of leading blade 16 to be achieved in any of these operations.

Figure 6:
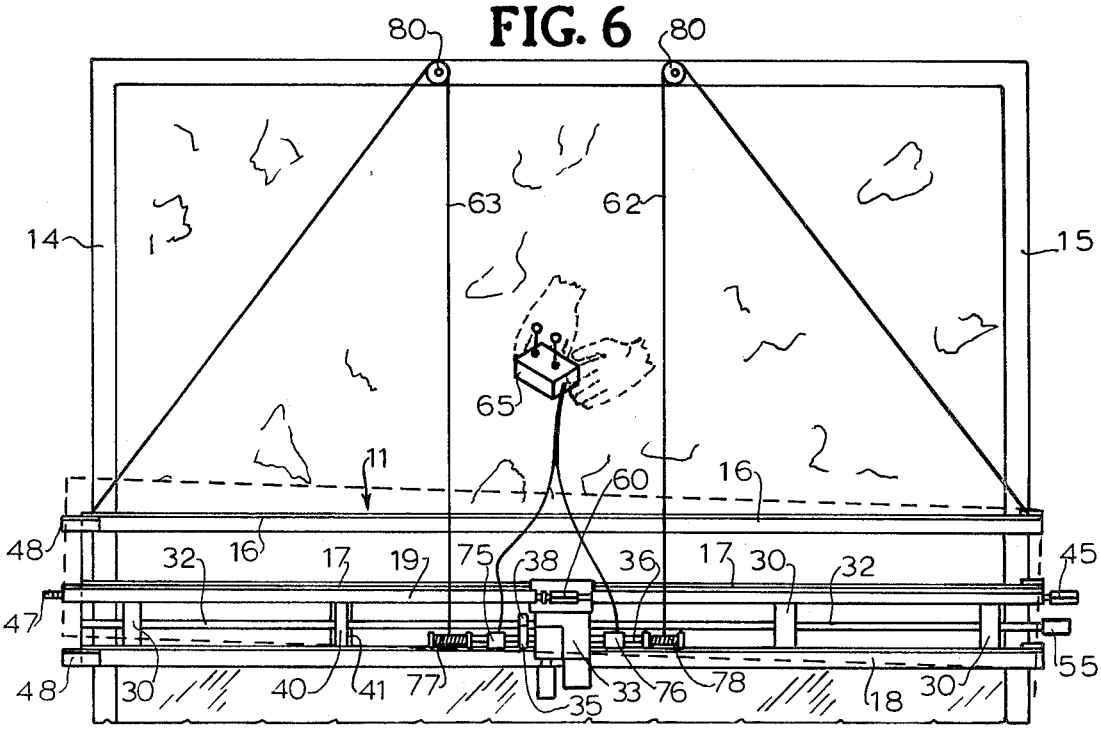
FIG. 6 is a plan view showing a base frame unit and associated winching mechanism for automatically winching the unit forward and with the bracing members removed for purpose of illustration.

As somewhat schematically illustrated in FIGS. 1 and 6, a winching arrangement allows the screed to be pulled forwardly by means of winching cables 62, 63 which are securely but detachably connected to the outside ends of leading screed blade 16. Thus, as cables 62, 63 pass around pulleys 80 and are wound onto the respective winching drums 77, 78, seen in FIG. 6, under the control of an operator through an appropriate control box 65 as depicted, screed 10 is moved forward on the surface of the concrete as it is pulled along on sideboards 14, 15 of the form. Either side of screed 10 may lead or lag as the operator determines and by appropriate use of control box 65 to simulate the sometimes useful sawing type movement due to the lack of complete uniformity in the concrete mix being screeded.

The winching apparatus and winch cable arrangement is schematically illustrated in FIG. 6 as applied to a single base frame unit 11. In FIG. 6, the output shaft 36 of motor 33 is extended outwardly on either side of motor 33 and has drive pulley 35 fixed on the output shaft 36 as previously described. Also, the previously-described V-belt 37 is utilized to turn the drive pulley 38 and thereby rotate vibrating shaft 32 all in the manner previously described. The output shaft 36 also drives a pair of mechanically controlled clutches 75, 76 mounted on base frame unit 11 and which are used to independently drive the pair of winching drums 77, 78 as illustrated in FIG. 6. The previously-mentioned winching cables 62, 63 are entrained on appropriate pulleys 80 as illustrated in FIG. 6 and the ends are attached to the ends of base frame unit 11 as shown. An appropriate control box 65 enables the operator through connecting control cabling to mechanically control the engagement and disengagement of the respective mechanical clutches 75, 76 and thus control the winching forces applied to the respective ends of base frame unit 11 such that engine 33 can be used both to cause unit 11 to vibrate as well as operate the winching mechanism. Also, the winching arrangement illustrated in FIG. 6 enables the winching operator to also effect the sawing type motion sometimes desired for screeding and wherein one end of screed 10, FIG. 1, may lead or lag the other end of screed 10 as and when desired to effect such sawing motion. It will be apparent that substantial manual labor is saved and substantially less physical effort is required to operate screed 10 than has been the case where screed 10 was manually pulled over the concrete as previously illustrated in U.S. Pat. No. 4,030,873.

In order to finish concrete with the concrete screed 10 of the invention, base frame unit 11 with drive engine 33 is used and as many additional extension sub-frame units, e.g., units 12, 13, of the required length are connected to the base frame unit 11 as previously described to span the distance between the particular concrete form sideboards 14, 15 being used. The form area is then filled with concrete and screed 10 is positioned at one end of the form. Cables 62, 63 are connected to screed 10 as previously described for winching in the manner illustrated in FIGS. 1 and 6. The screed operator then starts engine 33 so that shaft 32 is rotated within bearings 31 and pillar block bearing 40. The loose fit between shaft 32 and bearings 31 permits vibration of shaft 32, mating shafts included, as they are rotated. The screed operator then causes screed 10 to be moved along the surface of the concrete with the aid of winching drums 77, 78 as in FIGS. 1 and 6, so as to move screed 10 in the direction illustrated in FIGS. 1 and 3. The engine rotation also assists in the forward motion by causing the screed to creep forwardly in the manner previously explained. While this vibration process is going on, one or more workers fill in any low spots in the concrete in advance of screed 10. Leading screeding blade 16 initially provides a puddling or leveling operation. Rotating and vibrating shaft 32 imparts uniform vibrations throughout the entire length of screed blades 17, 18. The leading screed blade 16, however, receives and imparts only minimal vibration to the concrete surface and thus serves its primary purpose of leveling and puddling. During this process, screed blades 17, 18 have additional weight applied thereto by reason of engine 33 and its mounting arrangement. Also, the uniform vibration which is substantially all applied to blades 17, 18 provide a proper and improved finish to the surface of the concrete. The deflection or whipping of shaft 32 otherwise provides sufficient uniform vibrations throughout the length of screed 10 so that even those areas of screed 10 resting on form walls 14, 15 are thoroughly vibrated. Furthermore, the leading screed blade 16, maintains its utility as a puddling device even at the extremities of the screed adjacent form walls 14, 15. Furthermore, the concrete being operated on is adequately puddled and then vibrated to a sufficient degree to settle the concrete and prevent any voids or open areas in the concrete. Also, less concrete tends to flow under blade 17, the forwardmost blade of the pair of blades 17, 18, which effectively screeds the concrete.

While the described loose bearing fit and loose bearing mounting arrangement for shaft 32 has been found desirable for generating and imparting vibration to the base frame unit 11, it is recognized that other structural means could be associated with shaft 32 to generate and impart such vibrations without sacrificing other features of the invention. For example, shaft 32 could have a normal bearing fit and be provided with suitably-spaced eccentric weights to cause shaft 32 to impart the desired uniform vibrations to the trailing pair of blades 17, 18. Alternatively, shaft 32 could be mounted in offset bearings to create the desired vibration effect on blades 17, 18. That is, such alternative shaft vibration arrangements could be employed without impairing the utility of the three-bladed arrangement and other features of the invention.

I claim:

1. A portable vibrating concrete screed comprising:

(a) an elongate open structure frame mounting three spaced apart and fixedly positioned parallel blades adapted to engage and level concrete and to support the screed as said screed is moved over the concrete and with the most forward of said blades being adapted to effect a rough smoothing puddling-like action, said elongate open structure frame being in the form of an isosceles triangle in cross section, with the forward and trailing said screed blades being positioned at the lower outer corners of said triangle, said frame including a tubing member positioned at the apex of said triangle, the middle of said three blades being positioned below said apex and substantially evenly spaced between the forward and trailing blades and including cross braces fixed to and extending between said screed blades and said tubing member;

(b) bearings mounted on said frame between the trailing pair of said blades and spaced inwardly from each end of said frame;

(c) a vibrating element including a shaft supported for rotation in said bearing above said trailing pair of blades and extending throughout the length of said frame and beyond said bearings spaced inwardly from each end of said frame and structural means associated with said shaft designed upon rotation of said shaft to allow said shaft to vibrate said frame; and (d) a drive source carried by said frame for rotating said shaft at a sufficient speed to cause said shaft to impart uniform vibrations throughout the length of the trailing pair of said blades, said drive source comprising a gasoline engine fixed on said frame above the trailing pair of said blades, and belt and pulley means drivingly connecting said engine to said shaft, said engine being mounted in such manner on said frame to cause said screed to creep forwardly during operation thereof.

* * * * *